US006357611B1

(12) United States Patent
Chen

(10) Patent No.: US 6,357,611 B1
(45) Date of Patent: Mar. 19, 2002

(54) SECTIONAL RACK

(75) Inventor: Henry Chen, Tiapei (TW)

(73) Assignee: Protend Co., LTD, Taipei (TW)

( * ) Notice: Subject to any disclaimer, the term of this patent is extended or adjusted under 35 U.S.C. 154(b) by 0 days.

(21) Appl. No.: 09/540,186

(22) Filed: Mar. 31, 2000

(51) Int. Cl.[7] ..... A47F 5/14

(52) U.S. Cl. ..... 211/187; 211/181.1; 108/107; 108/147.12; 108/147.13

(58) Field of Search ..... 211/187, 182, 211/181.1; 108/106, 107, 144.11, 147.11, 147.12, 147.13, 147.15

(56) References Cited

U.S. PATENT DOCUMENTS 4,593,826 A * 6/1986 Bustos ..... 211/187
4,811,670 A * 3/1989 Kolvites et al. ..... 211/187 X
5,271,337 A * 12/1993 Kolvites et al. ..... 108/107
6,017,009 A * 1/2000 Swartz et al. ..... 108/147.13 X
6,113,042 A * 9/2000 Welsch et al. ..... 211/187 X

* cited by examiner

*Primary Examiner*—Daniel P. Stodola
*Assistant Examiner*—Erica B. Harris
(74) *Attorney, Agent, or Firm*—W. Wayne Liauh

(57) ABSTRACT

A sectional rack is constructed from multiple vertical supporting posts, horizontal shelves and connecting members. The supporting posts have a non-round cross section and the shelves have short sleeves provided at every corner thereof. Each supporting post is provided on its outer surface at a portion facing inward toward the rack with a plurality of equally spaced grooves. Each connecting member is adapted to firmly mount on the supporting post by engaging ribs provided on inner surface of the connecting member with the grooves on the supporting post. An outer surface of the connecting member opposite to the ribs is downwardly and outwardly inclined; and an inner surface of the sleeve of the shelf facing the inclined outer surface of the connecting member is correspondingly inclined. The association of the sleeve with the connecting member causes the inclined inner surface of the sleeve to apply a pressure on the inclined outer surface of the connecting member to force the ribs of the latter further into the grooves on the supporting post and thereby ensures stable connection of the shelf to the supporting post.

6 Claims, 8 Drawing Sheets

SECTIONAL RACK

BACKGROUND OF THE INVENTION

The present invention relates to a sectional rack, and more particularly to a sectional rack that is easy to assemble, disassemble and clean.

Sectional furniture is widely welcomed due to its convenience in storage and transportation. Some types of the sectional furniture in the assembled state have fixed shapes and dimensions that might not be suitable for an existing room space. Most consumers would appreciate that sectional furniture, particularly a rack, a closet and the like, includes sections that could be freely assembled to any desired shape and dimensions.

A sectional rack developed in the early stage includes sections that must be connected together through fastening members, and such fastening members usually require tools to tighten them. The assembling and disassembling of the conventional sectional rack is therefore complicated and inconvenient. A sectional rack including segmented supporting post is currently available in the market. The supporting post of such sectional rack are made of metal pipes having a plurality of annular grooves spaced on the pipe. Shelves to be connected to the supporting posts are provided at three or four corners thereof with short sleeves for putting around the supporting posts and thereby connecting the shelves to the post. FIG. 1 is a perspective of this type of sectional rack 1 having the segmented supporting posts 10. FIGS. 2 and 3 are fragmentary perspective and sectional views, respectively, of the sectional rack 1 of FIG. 1. The shelf 12 is connected to the supporting post 10 through a two-part connecting member 11. Each supporting post 10 is provided on its outer surface with a plurality of equally spaced horizontal annular grooves 13 and therefore looks like a segmented post. The two parts of the connecting member 11 may be opened or closed relative to each other. A radially inward projected flange 14 is annularly provided along an inner surface of the connecting member 11 at proper position, such that when the connecting member 11 is in a closed position, it may be put around the supporting post at a predetermined position by engaging the flange 14 with one of the grooves 13. The connecting member 11 in the closed position has a downward and outward inclined outer surface, making it looks like a truncated cone. The short sleeves 15 provide at four corners of each shelf 12 have a downward and outward inclined inner surface corresponding to the inclined outer surface of the connecting member 11. The sleeves 15 are separately put around the connecting members 11 mounted on the supporting posts 10 to, on the one hand, force the connecting members 11 toward the supporting posts 10 and, on the other hand, connect the shelves 12 to the supporting posts 10.

The following are some of the disadvantages of the above-described conventional sectional rack 1:

1. The annular grooves 13 on the supporting posts 10 tend to have dust cumulated therein and it is bothersome and time-consuming to remove such cumulated dust from the grooves.

2. The annular grooves 13 are densely provided on the supporting posts 10 to produce an unpleasant sight.

3. The sleeves 15 are fitted on the connecting members 11 with their inclined inner surfaces tightly pressing against and contacting with the inclined outer surfaces of the connecting members 11 to such an extent that they could not be easily disassembled from one another when necessary. A tool must be used to knock at the shelves 12 to separate the sleeves 15 from the connecting members 11. This is, of course, very inconvenient for a user.

U.S. Pat. Nos. 5,676,263; 5,303,645; 5,174,676; 4,991,725; 4,799,818; 4,595,107; 4,546,887 and 4,763,799 all refer to the above-mentioned segmented posts.

SUMMARY OF THE INVENTION

It is a primary object of the present invention to provide a sectional rack that is easy to assemble, disassemble and clean.

The sectional rack according to the present invention mainly includes multiple vertical supporting posts, horizontal shelves and connecting members. The shelves have short sleeves provided at every corner thereof. Each supporting post is provided on its outer surface at a portion facing inward toward the rack with a plurality of equally spaced grooves. Each connecting member is adapted to firmly mount on the supporting post by engaging ribs provided on inner surface of the connecting member with the grooves on the supporting post. An outer surface of the connecting member opposite to the ribs is downward and outward inclined; and an inner surface of the sleeve of the shelf facing the inclined outer surface of the connecting member is correspondingly inclined. The association of the sleeve with the connecting member causes the inclined inner surface of the sleeve to apply a pressure on the inclined outer surface of the connecting member to force the ribs of the latter further into the grooves on the supporting post and thereby ensures stable connection of the shelf to the supporting post.

The supporting posts for the sectional rack of the present invention have preferably a non-round cross section, so that the connecting members connected thereto are not easily rotatable relative to the post. Further, portions of the outer surfaces of the supporting posts facing outward relative to the rack are smooth and can be easily cleaned.

Moreover, portions of the inner surfaces of the sleeves and portions of the outer surfaces of the connecting members other than the inclined surfaces are straight surfaces. This allows the sleeves to fitly and firmly locate on the connecting members without becoming overtightly fitted on the latter. The rack can therefore be easily disassembled when necessary.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
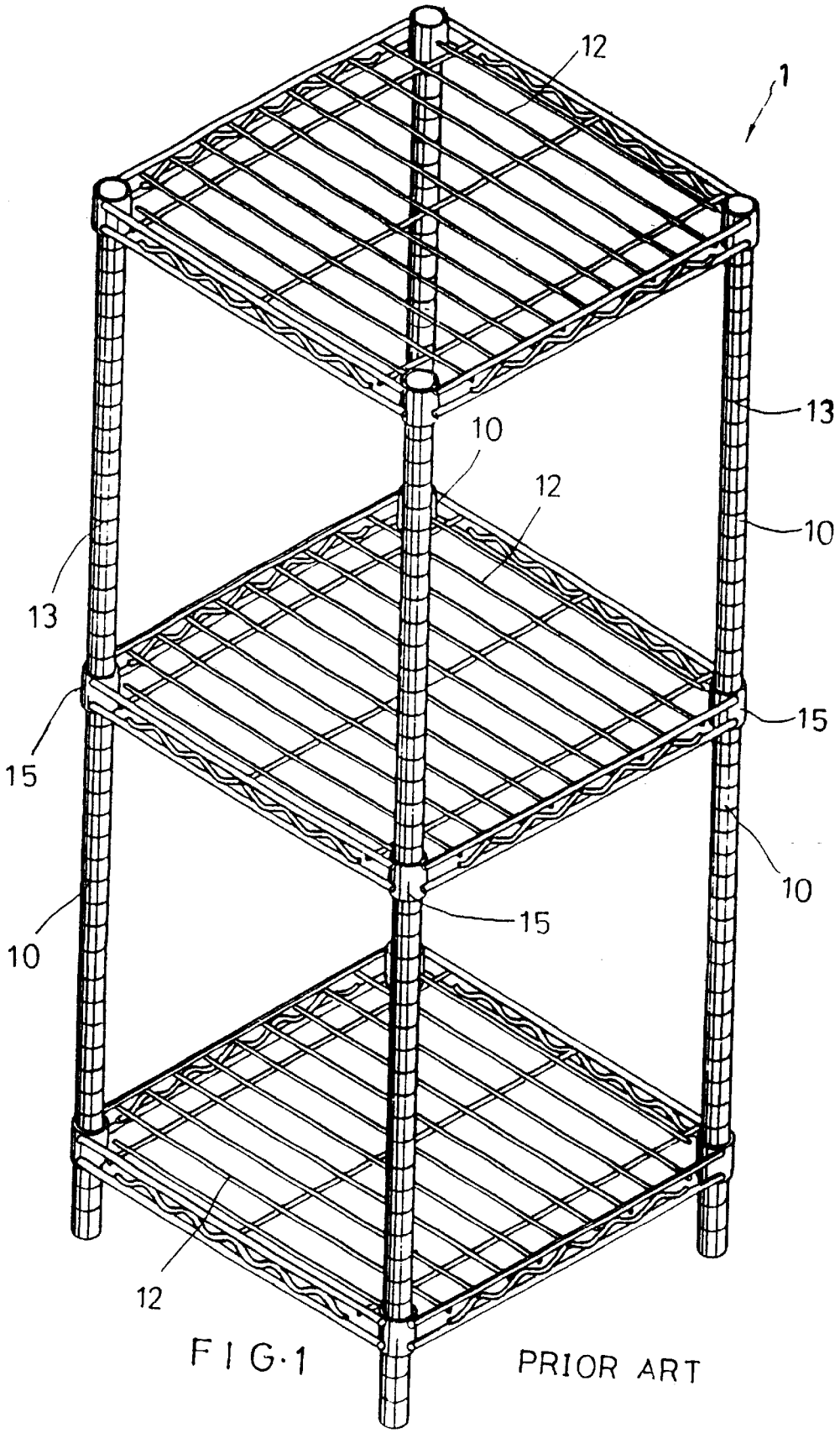
FIG·1 PRIOR ART
FIG. 1 is a perspective view of a conventional sectional rack including segmented supporting posts.
Figure 2:
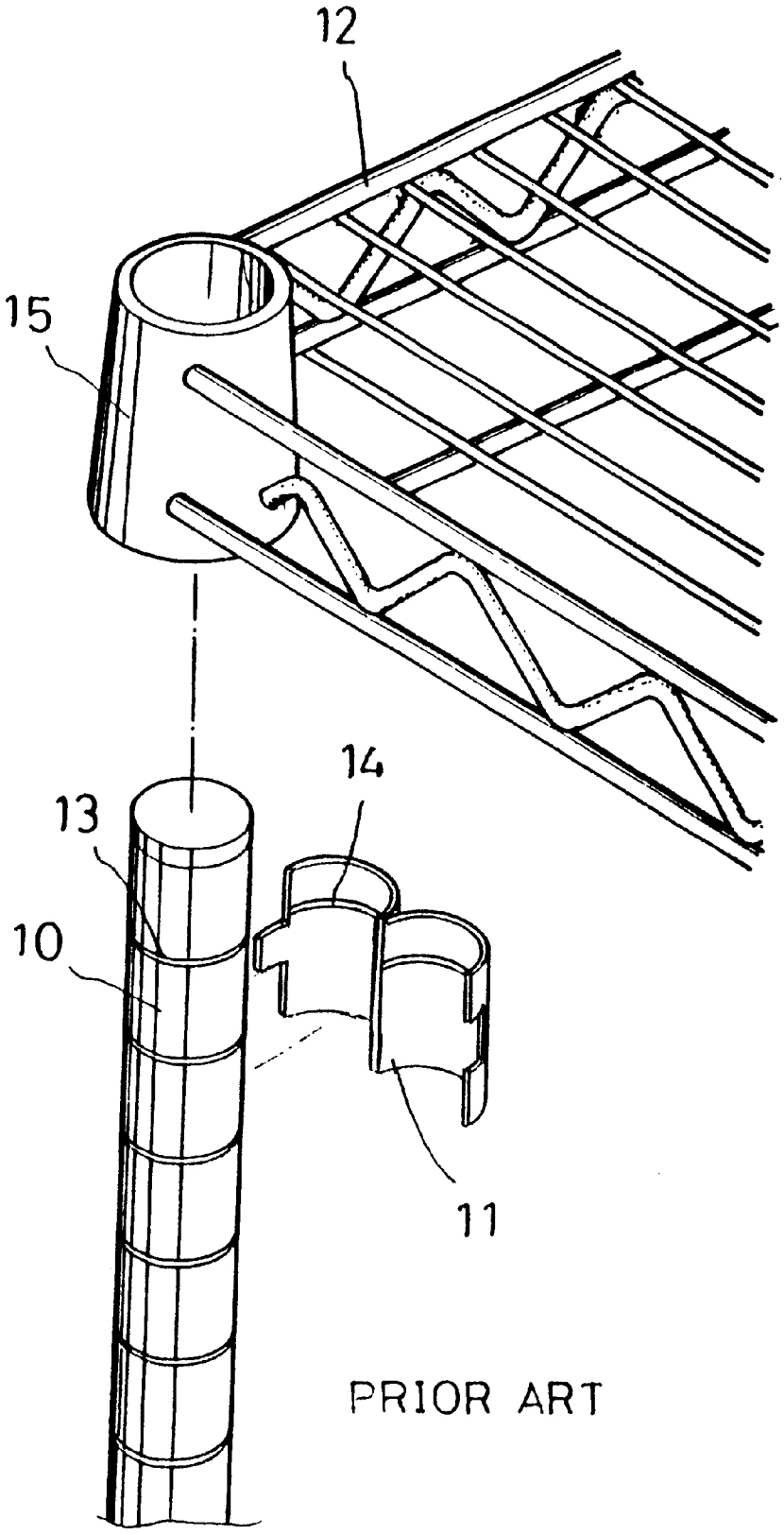
FIG. 2 is a fragmentary and exploded perspective view of the conventional sectional rack of FIG. 1.
Figure 3:
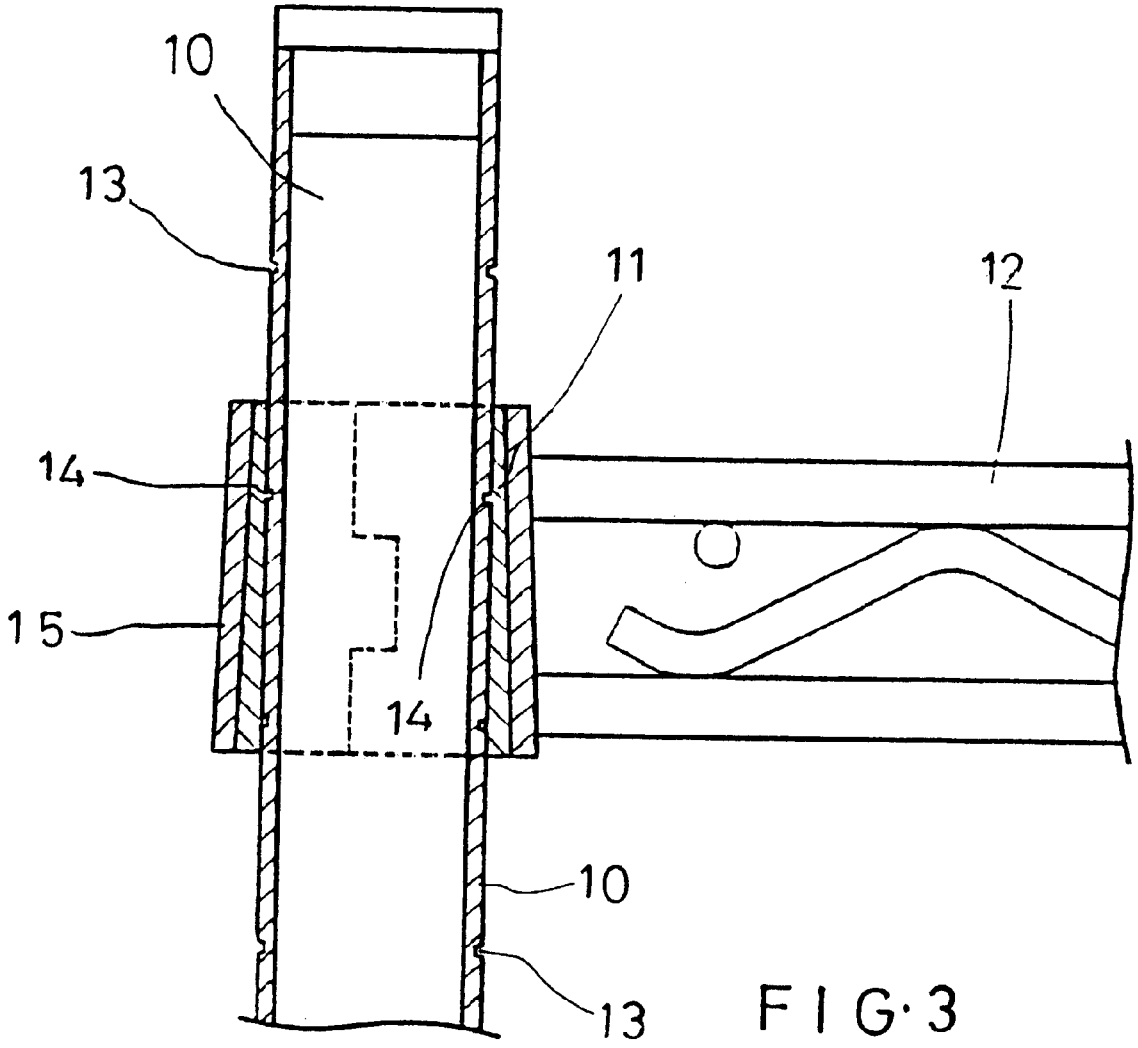
FIG. 3 is a fragmentary and assembled sectional view of the conventional sectional rack of FIG. 1.
Figure 4:
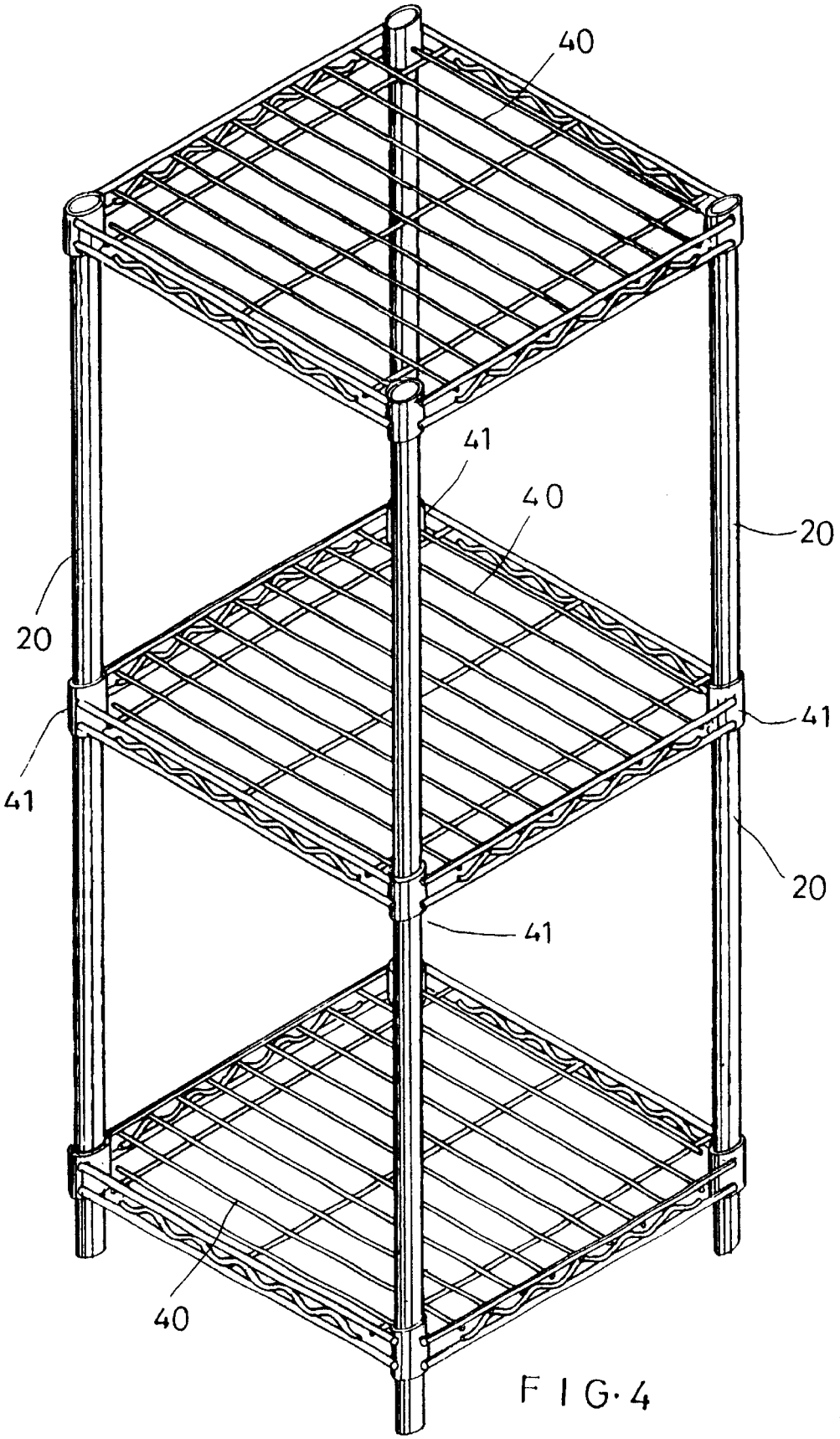
FIG. 4 is a perspective view of a sectional rack according to an embodiment of the present invention.
Figure 5:
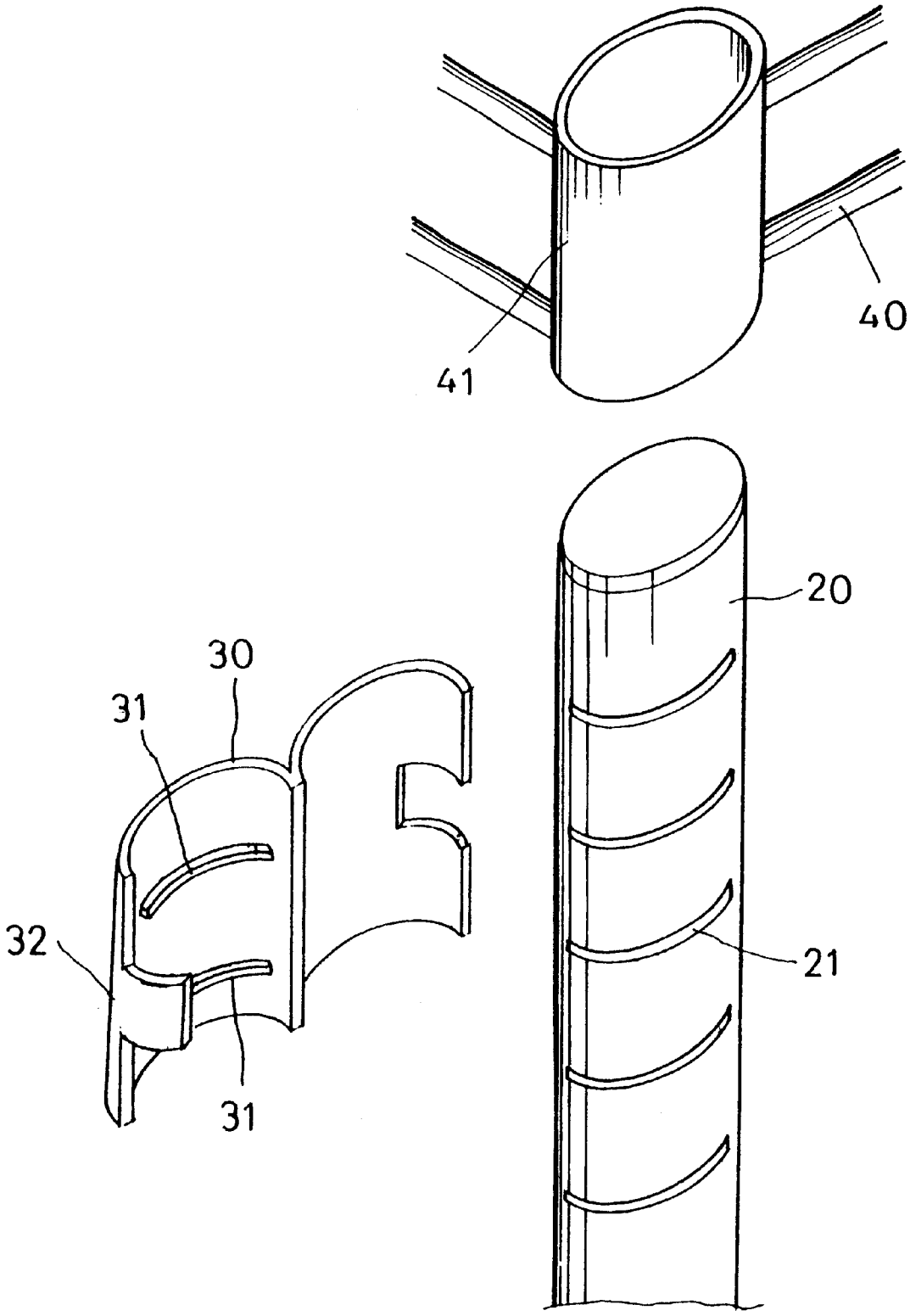
FIG. 5 is a fragmentary and exploded perspective view of the sectional rack of FIG. 4.

Please refer to FIGS. 4 and 5 that are assembled and fragmentary exploded perspective views, respectively, of a sectional rack according to an embodiment of the present invention. As shown, the sectional rack mainly includes a predetermined number of vertical supporting posts 20, a predetermined number of horizontal shelves 40, and a plurality of connecting members 30. Each connecting member 30 includes integrally connected first and second halves that may be opened or closed relative to each other. When the two halves of a connecting member 30 are closed relative to each other, the connecting member 30 is adopted to enclose and therefore locate on a vertical supporting post 20 at a predetermined position. Each horizontal shelf 40 is provided at every corner thereof with a short sleeve 41. Each shelf 41 is adapted to fit around the connecting member 30 located on the supporting post 20, so that the horizontal shelf 40 may be firmly connected to and mounted on the supporting post 20.

Each vertical supporting post 20 of the sectional rack of the present invention is provided at a portion of its outer surface generally facing inward toward the rack with a plurality of equally spaced, horizontal grooves 21, and each connecting member is provided at an inner surface thereof, for example, the first half with, two spaced horizontal ribs 31. The ribs 31 have dimensions and are spaced corresponding to the grooves 21 on the supporting post 20. By engaging the ribs 31 with selected grooves 21 and closing the second half to the first half of the connecting member 30, the connecting member 30 is firmly located on the supporting post 20 at a selected position.

The first half of the connecting member 30, that has ribs 31 provided at an inner surface thereof, has a downwardly and outwardly inclined outer surface 32; and a portion of an inner surface of each sleeve 41 of the shelf 40 that will contact with the first half of the connecting member 30 when the sleeve 41 is fitted around the connecting member 30 has an inclined surface 42 corresponding to the inclined outer surface 32 of the connecting member 30. Please also refer to FIG. 6. When the sleeves 41 of the shelf 40 are duly fitted around the connecting members 30, the inclined surfaces 42 apply a pressure on the inclined surfaces 32 to force the internal ribs 31 of the first halves of the connecting members 30 further into the grooves 21 on the supporting posts 20, ensuring that the sleeves 41 are firmly located around the connecting members 30 and thereby stably connecting the shelves 40 to the supporting posts 20.

Figure 6:
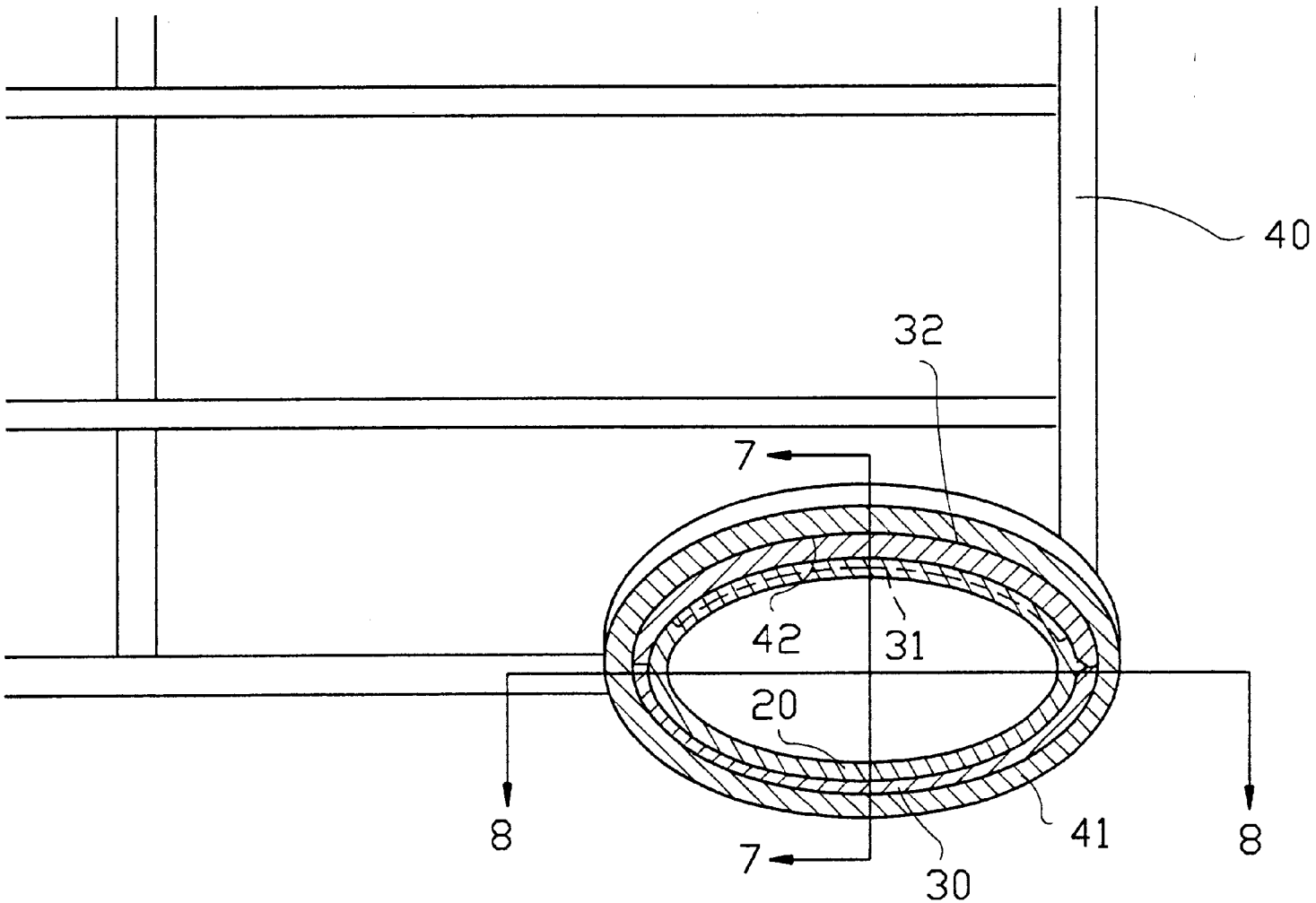
FIG. 6 is a fragmentary and assembled sectional view of the sectional rack of FIG. 4.

The supporting post 20, and accordingly the sleeve 41 and the connecting member 30, preferably have a cross section that is not a circle, so that the connecting member 30 and the sleeve 41 could be more easily correctly oriented and assembled to the supporting post 20. FIG. 6 illustrates the sectional rack of the present invention having supporting posts 20, connecting members 30 and shelf sleeves 41 with a substantially elliptic cross section. In this case, the supporting post 20 is provided at a portion of its outer surface having the large length and facing inward with the grooves 21. The rest portion of the outer surface of the supporting post 20 is smooth, visually pleasant, and can be easily cleaned. The non-round cross section of the supporting post 20 also enables a user to correctly orient the grooves 21 easily. Moreover, the connecting members 30 are not rotatable relative to the supporting post 20 once they have been fitted on the elliptic-sectioned supporting post 20 and this makes the sectional rack to be easier and more stably assembled. By providing the grooves 21 on the supporting post 20 only at a portion facing inward toward the rack, a rack having smooth appearance viewed from every side is obtained.

Figure 8:
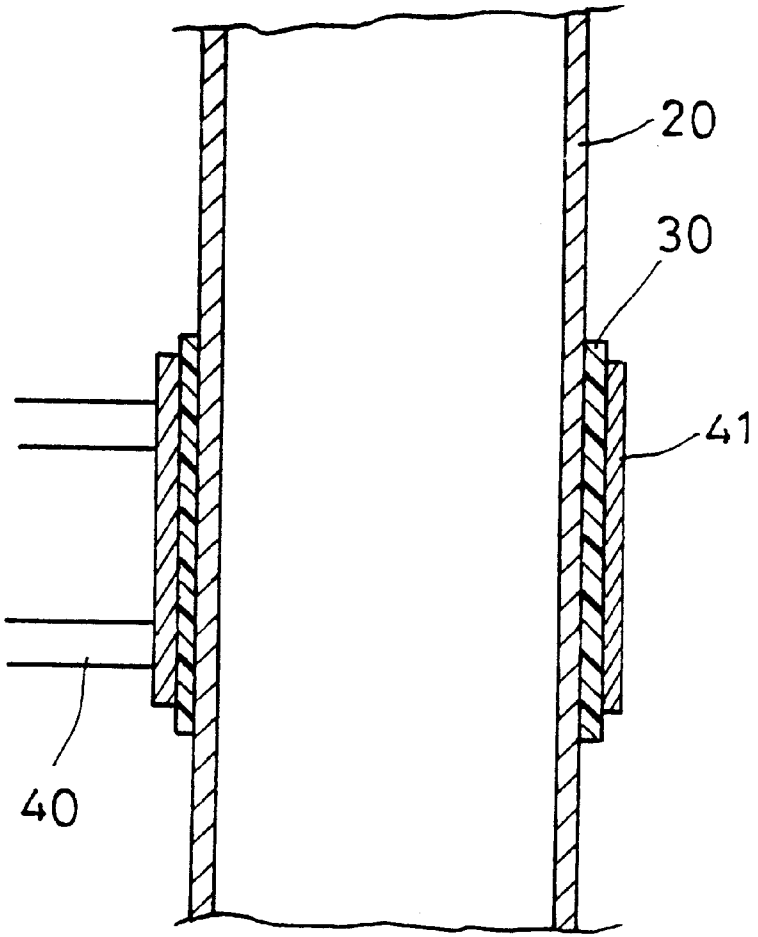
FIG. 8 is a fragmentary cross sectional view taken on line 8—8 of FIG. 6.
Figure 7:
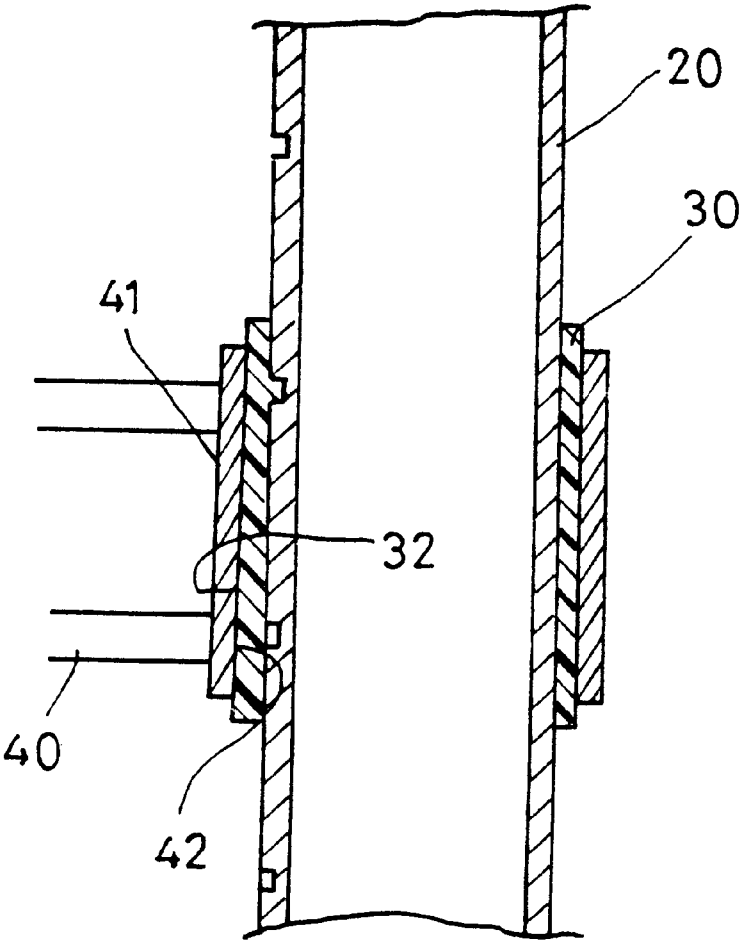
FIG. 7 is a fragmentary cross sectional view taken on line 7—7 of FIG. 6.

FIGS. 7 and 8 are fragmentary sectional views of the rack of the present invention showing the portion at where the shelf 40 is connected to the supporting post 20 via the connecting member 30. Please refer to FIG. 7, a portion of the outer surface of the connecting member 30 facing toward the rack, that is, the outer surface of the first half of the connecting member 30, is a downward and outward inclined surface 32, while the rest portion of the outer surface of the connecting member 30, or the outer surface of the second half of the connecting member 30, is a straight surface. Similarly, a portion of the inner surface of each sleeve 41 of the shelf 40 facing toward the inclined surface 32 is an inclined surface 42 corresponding to the inclined surface 32 while the rest portion of the inner surface of each sleeve 41 is a straight surface. Whereby, when the sleeve 41 is put around the connecting member 30, only the inclined surface 42 would apply a downward pressure against the inclined surface 32 to cause the sleeve 41 to contact with the connecting member 30 in a tight fit manner. On the other hand, the straight inner surface of the sleeve 41 does not apply any pressure on the straight outer surface of the connecting member 30. With these arrangements, the connecting members 30 serve to prevent the shelves 40 from sliding downward from the supporting posts 20 without being over tightly associated with the sleeves 41. Such a relation between the sleeves 41 and the connecting members 30 enables the rack to be easily disassembled when necessary. Since the inclined surfaces 32 and 42 are invisible from outside of the connecting members 30 and the sleeves 41, joints of the shelves 40 and the supporting posts 20 at the sleeves 41 and the connecting members 30 are always beautifully straight when viewing from different angles, as shown in FIGS. 7 and 8.

Figure 9:
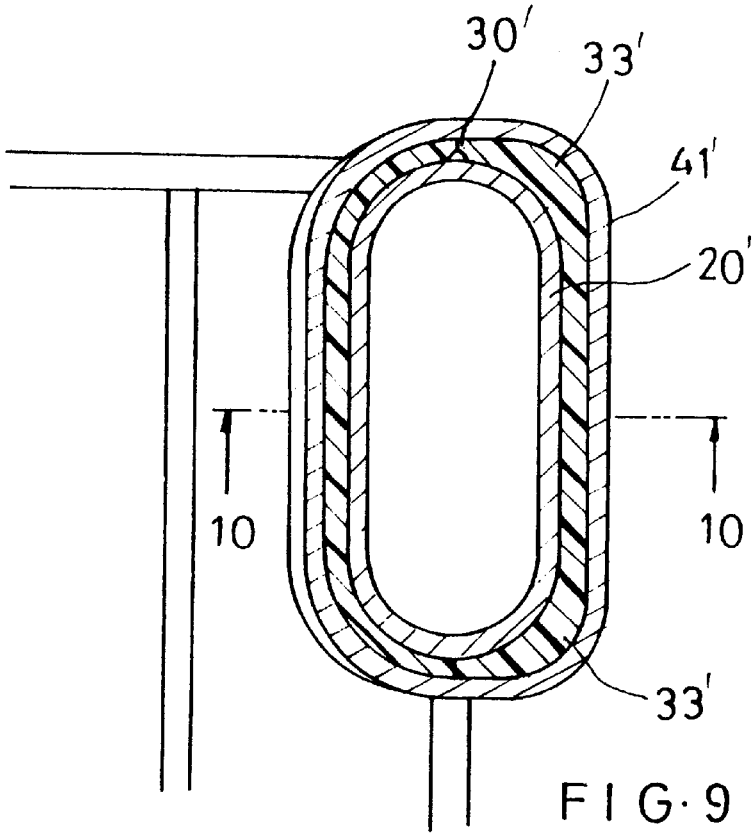
FIG. 9 is a fragmentary top view of a sectional rack according to another embodiment of the present invention.
Figure 10:
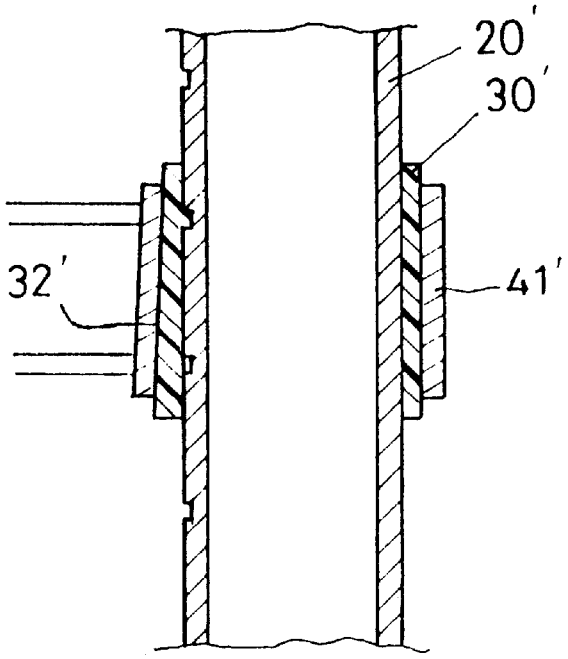
FIG. 10 cross sectional view taken on line 10—10 of FIG. 9.

FIG. 9 illustrates another embodiment of the sectional rack of the present invention having supporting posts 20', connecting members 30' and shelf sleeves 41' with a substantially oblong cross section. And FIG. 10 is a cross sectional view taken on line 10—10 of FIG. 9. In this embodiment, each vertical supporting post 20' is also provided at a portion of its outer surface facing inward toward the rack with equally spaced horizontal grooves; each connecting member 30' includes integrally connected first and second halves and only the first half thereof facing toward the rack has a downward and outward inclined surface 32'; and the sleeve 41' has an inclined inner surface corresponding to the inclined surface 32'. The connecting member 30' in this embodiment is further provided at two corners facing outward away from the rack with slightly projected portions 33' (see FIG. 9), so that the sleeve 41' of the shelf (not shown) would not rotate relative to the connecting member 30' when the sleeve 41' is fitted around the connecting member 30'.

The following are some of the advantages of the present invention:

1. The supporting posts 20 are smooth and visually beautiful and pleasant at the portions of their outer surfaces facing outward away from the rack, and make the rack of the present invention more attractive to the consumers.

2. The locally provided inclined surfaces 32 and 42 on the connecting members 30 and the sleeves 41, respectively, allow the connecting members 30 to, on the one hand, stop the sleeves 41 from sliding downward along the supporting posts 20 and, on the other hand, keep suitable tight fit relation with the sleeves 41 to facilitate disassembling of the rack when necessary.

3. The supporting posts 20 do not necessarily have a round cross section. A non-round cross section of the supporting posts 20, connecting members 30 and sleeves 41 facilitates easy and correct orientation and assembling of these components to form the rack.

4. The supporting posts 20 have fewer grooves 21 and can therefore be cleaned easier.

What is claimed is:

1. A sectional rack comprising:

a plurality of oval-shaped vertical supporting posts, each with a periphery; a plurality of rectangular horizontal shelves each having an oval-shaped short sleeve provided at every corner thereof, and a plurality of oval-shaped connecting members adapted to mount on said supporting posts and respectively cooperative with said sleeves to connect said shelves to said supporting posts;

each said supporting post having an outwardly-facing outer surface and an inwardly-facing outer surface, said outwardly-facing outer surface being smooth and said inwardly-facing outer surface being provided with a plurality of horizontal grooves, wherein each of said grooves is formed only over a quadrant of said periphery so that it can be hidden from view when viewed from front and an adjacent side;

each said connecting member having a first half and a second half pivotably connected together, said first half of said connecting member having an inner surface provided with a plurality of spaced ribs each matching one said groove formed on said supporting posts, such that said connecting member can be mounted on said supporting post by engaging said ribs into said corresponding grooves at a certain selected position on said supporting post, said first half of said connecting member also having an inclined outer surface with its radius increasing downward, and said second half of said connecting member having a straight surface; and each said sleeve of said shelf having an inner surface, a portion of which being inclined to match the inclined surface of said first half of said connecting member;

whereby when said sleeve of said shelf is associated with said connecting member, said inclined inner surface of said sleeve applies a pressure on said inclined outer surface of said connecting member to force said ribs on said inner surface of said connecting member tightly into said grooves on said supporting post, and thereby ensures stable connection of said shelf to said supporting post at said connecting member.

2. A sectional rack comprising:

a plurality of oval-shaped vertical supporting posts, each with a periphery; a plurality of rectangular horizontal shelves, each having an oval-shaped short sleeve provided at every corner thereof, and a plurality of oval-shaped connecting members adapted to snap on said supporting posts, said connecting members cooperate with said sleeves to fix said shelves to said supporting posts;

each of said supporting posts having an outwardly-facing outer surface and an inwardly-facing outer surface, said outwardly-facing outer surface being constructed to have a smooth surface and said inwardly-facing outer surface being provided with a plurality of horizontal grooves, wherein each of said grooves is formed only over a quadrant of said periphery so that it can be hidden from view when viewed from front and an adjacent side;

each of said connecting members having a first half and a second half pivotably connected together, said first half of said connecting member having an inner surface provided with at least one rib matching with one of said grooves formed on said supporting posts, such that said connecting member can be mounted on said supporting post by engaging said rib into a corresponding one of said grooves, said first half of said connecting member also having an inclined outer surface, with its radius increasing downward; and each of said sleeves of said shelf having an inner surface, a portion of which being inclined matching said inclined surface of said first half of said connecting member, so that said sleeve can be sleeved around said connecting member to cause said rib to be firmly engaged with said groove.

3. The sectional rack according to claim 2, wherein said inner surface of said first half of said connecting member is provided with a plurality of spaced ribs.

4. The sectional rack according to claim 2, wherein said horizontal grooves are equally spaced.

5. The sectional rack according to claim 2, wherein said first and second halves of said connecting members are formed into an interlocking configuration.

6. The sectional rack as claimed in claim 2, wherein said second half of said connecting member having a straight surface.

* * * * *